US005347095A

United States Patent [19]

Zeder

[11] Patent Number: 5,347,095

[45] Date of Patent: Sep. 13, 1994

[54] ELECTRICAL RECEPTACLE FOR USE WITH ANNUNCIATOR APPARATUS FOR MONITORING ELECTRICAL CONNECTIONS

[76] Inventor: Abraham Zeder, 8 Wintergreen Cir., Andover, Mass. 01810

[21] Appl. No.: 4,532

[22] Filed: Jan. 14, 1993

Related U.S. Application Data

[62] Division of Ser. No. 725,979, Jul. 5, 1991, Pat. No. 5,258,744.

[51] Int. Cl.[5] ..... H01R 33/96

[52] U.S. Cl. ..... 200/51.09; 200/51.02; 439/188

[58] Field of Search ..... 200/51 R, 51.02, 51.03, 200/51.04, 51.09, 51.1, 51.11, 51.12, 43.04, 43.05; 439/188 X, 490, 489, 488, 911

[56] References Cited

U.S. PATENT DOCUMENTS

| | | | |
|---|---|---|---|
| 3,090,948 | 5/1963 | Cremer | 200/51.10 |
| 4,028,691 | 6/1977 | Zeder | 200/51 R X |
| 4,075,617 | 2/1978 | Wireman | 200/51.1 X |
| 4,097,843 | 6/1978 | Basile | 200/51.1 X |
| 4,271,337 | 6/1981 | Barkas | 200/51.09 |
| 4,853,823 | 8/1989 | Arechavaleta et al. | 200/51.09 X |
| 5,095,182 | 3/1992 | Thompson | 200/43.04 X |
| 5,113,045 | 5/1992 | Crofton | 200/43.05 X |

*Primary Examiner*—Glenn T. Barrett
*Attorney, Agent, or Firm*—Pearson & Pearson

[57] ABSTRACT

An electrical receptacle for use with an annunciator for indicating the removal of an electrical plug from the electrical receptacle. The electrical receptacle includes neutral switching contacts actuated in response to the insertion of a plug into the receptacle. An input circuit in the annunciator apparatus monitors the state of the neutral switching contacts and couples signals produced when a plug is removed to a latching circuit thereby to produce an audible or electrical indication of plug removal.

2 Claims, 4 Drawing Sheets

30

ELECTRICAL RECEPTACLE FOR USE WITH ANNUNCIATOR APPARATUS FOR MONITORING ELECTRICAL CONNECTIONS

CROSS REFERENCE TO RELATED APPLICATION

This application is a division of my copending U.S. patent application Ser. No. 07/725,979 filed Jul. 5, 1991, U.S. Pat. No. 5,258,744, for Annunciator Apparatus for Monitoring Electrical Connections.

BACKGROUND OF THE INVENTION

1. Field of the Invention

This invention generally relates to annunciator apparatus and more particularly to apparatus that announces the unauthorized or inadvertent removal of a plug from an electrical receptacle.

2. Description of Related Art

The removal of an electrical plug from a receptacle is a common occurrence. In many situations this step occurs as a normal event. However, in others this step represents an unauthorized or inadvertent action that requires some immediate response. For example, removing the plug of an electrical appliance in a store may indicate that someone is stealing the appliance. In other situations the removal of the plug may indicate that critical apparatus has ceased to function. In these or other situations it is important to announce the occurrence of such a step by audible or electrical signalling.

These situations, particularly attempted thefts of electrical equipment, have led to the development of various theft deterring apparatus. The simplest apparatus for deterring theft comprises mechanical locking assemblies, such as cables and locks, that physically bind an appliance to a wall, counter or other fixture to prevent its physical removal. Such mechanical assemblies, however, can be cumbersome to use, especially in stores where individuals properly may move the appliances. It is relatively easy for an individual intent on stealing the appliance to defeat these mechanical locking assemblies and remove the appliance. Moreover, these assemblies do not inherently have any capability to announce the occurrence of unauthorized actions.

There is a range of alarms and other annunciator apparatus that provides on-site or remote signalling that are used in a theft deterring role. In one approach electrical receptacles are modified to provide mechanical or optical switching functions that respond to the presence or absence of a ground or neutral plug terminal or the like. Alarm circuits provide an alarm whenever a plug is not present. The following United States Letters Patent disclose various embodiments of such apparatus:

| | | |
|---|---|---|
| 3,090,948 | (1963) | Cremer |
| 3,192,518 | (1965) | Sliman |
| 4,097,843 | (1978) | Basile |
| 4,591,732 | (1986) | Neuenschwander |
| 4,845,719 | (1989) | Posey |

In accordance with other approaches separate electronic monitoring units mount on appliances or centrally disposed electronic circuits monitor wire lengths or other conditions that could indicate the removal of an electrical plug. The following United States Letters Patent disclose apparatus of this general category:

| | | |
|---|---|---|
| 4,327,360 | (1982) | Brown |
| 4,680,574 | (1987) | Ruffner |
| 4,736,195 | (1988) | McMurtry et al |
| 4,945,335 | (1990) | Kimura et al |

The following United States Letters patent disclose apparatus that monitors the insertion or removal of a plug from a receptacle:

| | | |
|---|---|---|
| 4,075,617 | (1978) | Wireman |
| 4,028,691 | (1977) | Zeder |

The Wireman patent discloses a structure including modified poles in an electrical receptacle. Specifically each receptacle contains an added spring coil between a neutral connection and an auxiliary contact. The auxiliary contact has insulating portions on either side of a conductive portion. Each insulating portion isolates the neutral and auxiliary connections when a plug is either in place or removed. A momentary contact occurs as a plug is inserted or removed. Alarm circuitry associated with the receptacle responds to both transient conditions by sounding an alarm. An operator must shift the system to a test mode to disable the alarm circuit before inserting a plug. If the system is not in a test mode, plug insertion will produce an alarm. Thus, this apparatus may produce false indications of problems unless specific operating steps are followed.

In accordance with the Zeder patent, filed by the same Applicant as the present invention, a plunger extends through the center of each receptacle of a duplex outlet. Each plunger controls corresponding external switching contacts that constitute an input to an alarm circuit. Any time a plug is removed, spring bias on the corresponding switch contacts opens the switch and an alarm sounds. A special cover can be located in any unused pole position to prevent erroneous alarms, but such covers are subject to being lost. The plunger can be broken; when this occurs, the entire receptacle must be replaced. It is also possible to block the plunger while the plug is installed and then remove the plug without any alarm. Despite these characteristics, apparatus constructed in accordance with the Zeder patent has been accepted for a number of applications where theft deterrence and other monitoring are important.

SUMMARY

Therefore it is an object of this invention to provide apparatus that reliably announces the unauthorized or unintentional removal of a plug from a receptacle.

Another object of this invention is to provide an apparatus for announcing the removal of a plug from a receptacle that distinguishes between the steps of plug removal and plug insertion.

Still another object of this invention is to provide annunciator apparatus that is reliable and simple to operate.

Annunciator apparatus constructed in accordance with this invention monitors the transition of an electrical switch in an electrical circuit from a first state to a second state. The annunciator apparatus includes a power supply means that connects to the electrical circuit for energizing the apparatus. An input circuit produces first and second transition signals in response to switch transitions from the first to the second state and from the second to the first state respectively. Transition sensing produces transition sensed signals in response to the first transition signals. Annunciators respond to the transition sensed signal by producing an alarm.

More specifically, this invention is particularly adapted for use with electrical receptacles that include a switching actuator that makes electrical contact between external terminals and internal contact structures. The input circuit connects to the electrical switch and produces the first transition signal in response to the plug's being removed from the receptacle and a second transition signal in response to the plug's being inserted into the receptacle. The transition sensing means produce a transition sensed signal in response to the first transition signal to cause the annunciator to produce an audible or electrical indication. The electrical switch is constituted by switching contacts on the neutral side of the receptacle.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
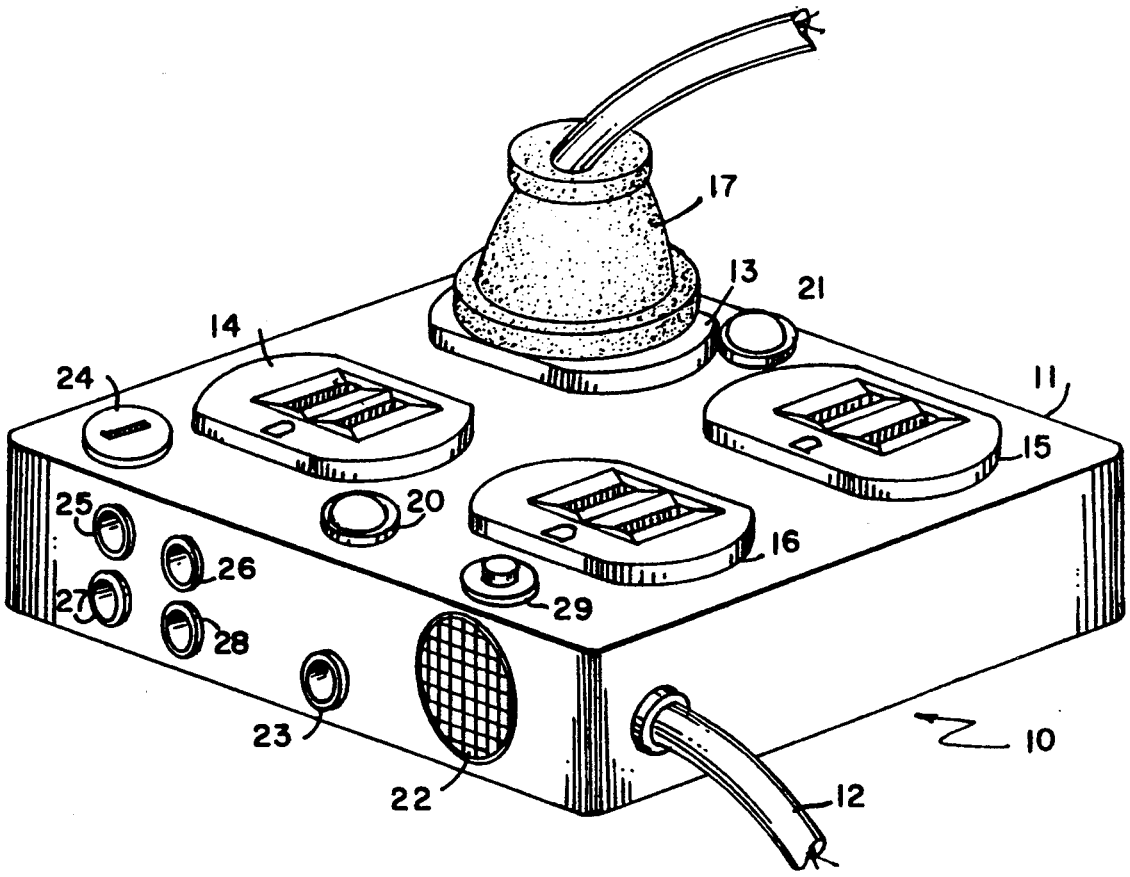
FIG. 1 is a perspective view of an embodiment of an annunciator apparatus that embodies this invention.

FIG. 1 discloses one embodiment of annunciator apparatus 10 constructed in accordance with this invention with a housing 11 and a power cord 12 that connects to a standard 120- or 240-volt AC supply with power and neutral conductors and normally a ground conductor. Typically the power cord connects to a receptacle in a secure location remote from the apparatus being monitored.

The specific apparatus 10 in FIG. 1 has four receptacle positions 13, 14, 15 and 16 and depicts a single plug 17 inserted in receptacle position 13. Normally the receptacle positions 13 and 14 and associated structure are combined in a single duplex outlet. Similarly another duplex outlet can define the receptacle positions 15 and 16. In the following discussion the term "receptacle" means to include the structure associated with a "receptacle position". Detailed receptacle structures are discussed in more detail later in connection with FIGS. 2 and 3.

An indicator light 20 illuminates whenever ac power energizes the receptacles 13 through 17. An alarm light 21 illuminates as a visual indictor that the alarm circuitry is working. An audio alarm sounds from a speaker 22, and a relay jack 23 provides a means for indicating an alarm to a remote location is connected to normally open or normally closed relay contacts inside the housing 11. A key-operated reset switch 24 provides a means for authorized personnel to clear the various alarm indications after an alarm condition; the alarm light 21 extinguishes whenever the reset switch 24 is active. The housing 10 additionally includes a plurality of input jacks 25, 26, 27 and 28 that adapt the apparatus for monitoring remote locations in response to external switch contacts. A circuit breaker reset button 29 allows personnel to reset an internal circuit breaker that provides overload protection.

If the apparatus 10 is operating in the configuration shown in FIG. 1, both the power indicator 20 and the alarm light 21 are lit. An authorized removal of the plug 17 requires personnel to operate the key-operated reset switch 24 to block any alarm by disabling the alarm circuit. When this occurs, the alarm light 21 turns off. Then the individual returns the reset switch 24 to a normal position and enables the alarm circuit and the alarm light 21 turns on again. If someone removes the plug without authorization, the apparatus 10 announces the action. Specifically, the speaker 22 produces an audible alarm and the relay contacts associated with the relay jack 23 change state. This alarm annunciation continues until authorized personnel activate the reset switch 24. If someone inserts a plug into the receptacle 14, 15 or 16, no alarm occurs. No alarms occur as a result of the absence of any plug in any receptacle position. Only the removal of a plug without authorization produces an alarm.

Figure 2:
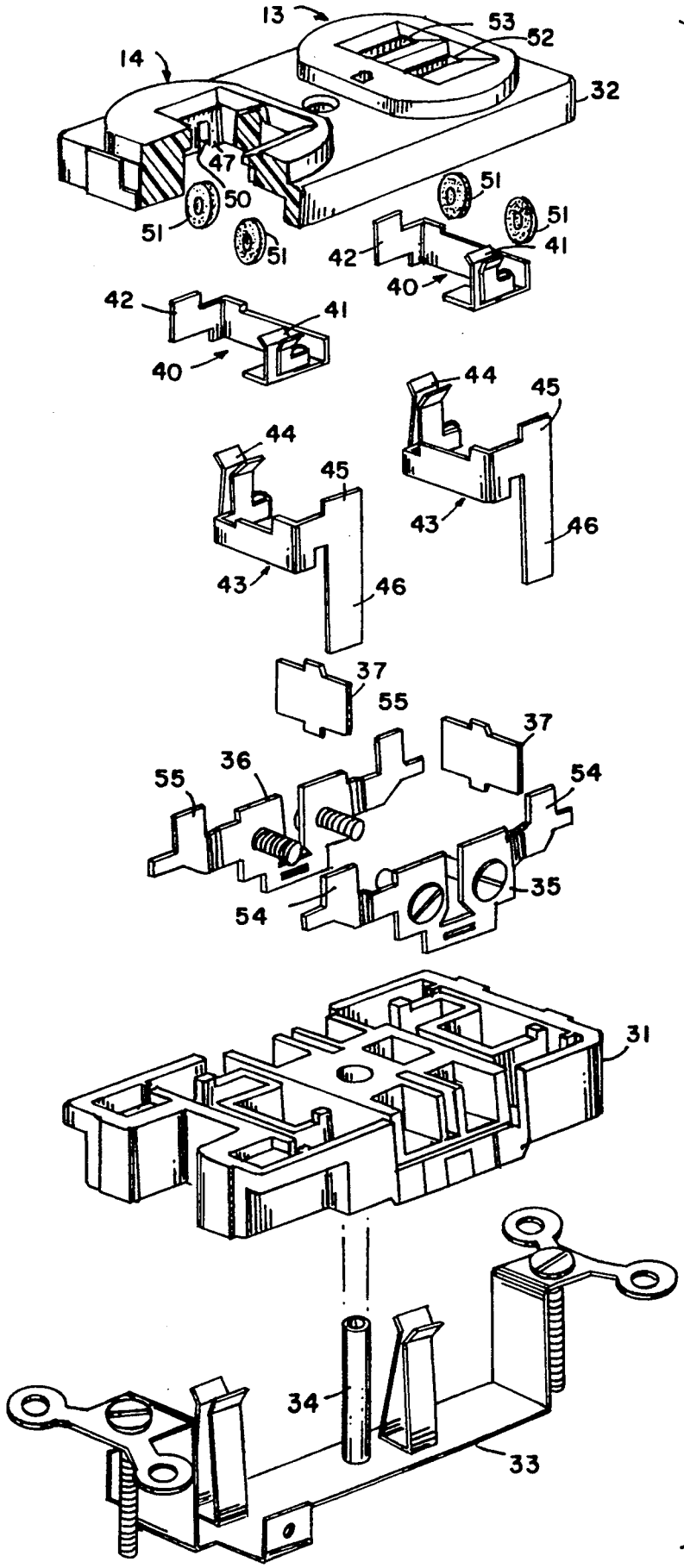
FIG. 2 is an exploded perspective view of the components of one embodiment of an electrical receptacle adapted to be used with this invention.

FIG. 2 discloses one embodiment of a standard duplex outlet 30 that is modified in accordance with this invention. For purposes of explanation it is assumed that the duplex outlet 30 corresponds to the duplex outlet that provides receptacle positions 13 and 14 in FIG. 1. The outlet 30 includes an insulating base 31 and a complementary insulating cover 32 that form a receptacle having diverse barriers and internal cavities for accepting and supporting the various conductive and other internal components of the receptacle. A ground strap 33 with a central rivet 34 that passes through apertures in the housing 31 and cover 32 clamps the various parts together. A neutral wiring terminal 35 and power wiring terminal 36 in parallel side cavities of the housing 31 provide a means for affixing power and neutral ac supply conductors to the duplex outlet 30. Insulating spacers 37 provide an insulating barrier if it is desired to separate the two poles by severing links on the terminals 35 and 36.

U-shaped power contact engaging structures 40 with spaced female contacts 41 and a tab 42 on opposite legs of the U-shaped structure lie in other cavities of the housing 31. Neutral contact engaging structures 43 have a similar structure with female contacts 44 and tabs 45. In accordance with this invention, however, the neutral contact engaging structures 43 are modified by adding downward extensions 46 from the tab 45. Each extension 46 passes through and exits externally to the base 31 and thereby constitutes a conductive feedthrough means.

The cover 32 has an internal barrier and slot, such as the barrier 47 and slot 50 shown with respect to the receptacle 14 that receives an activating disk 51. Activating disks 51 are associated with each of the power and neutral contact structures and normally align to the center of the switch with respect to tabs 42 and 45 respectively. When the duplex outlet 30 is assembled, the activating disks 51 also align under the power and neutral slots or apertures 52 and 53 formed at each of the receptacle positions.

As the male terminals of a plug pass through the slots 52 and 53 they force the corresponding activating disks 51 simultaneously toward the sides of the outlet 30. The activating disks 51 engage and displace the tabs 42 and 45 simultaneously. The tabs 45 contact tabs 54 to connect the neutral terminal 35 and the neutral contact structures 43. A similar action brings the tabs 42 into contact with the tabs 55 on the power wiring terminal 36. When a plug is removed from the receptacle, the tabs 42 and 45 return to an unbiased state and separate from the tabs 55 and 54 thereby breaking any electrical contact between them. The tabs 42 and 55 and the tabs 45 and 54 constitute electrical switches with first and second switching terminals. In this embodiment the disks 51 act as switch actuators that respond to the insertion of plug contacts into the receptacle.

Figure 3:
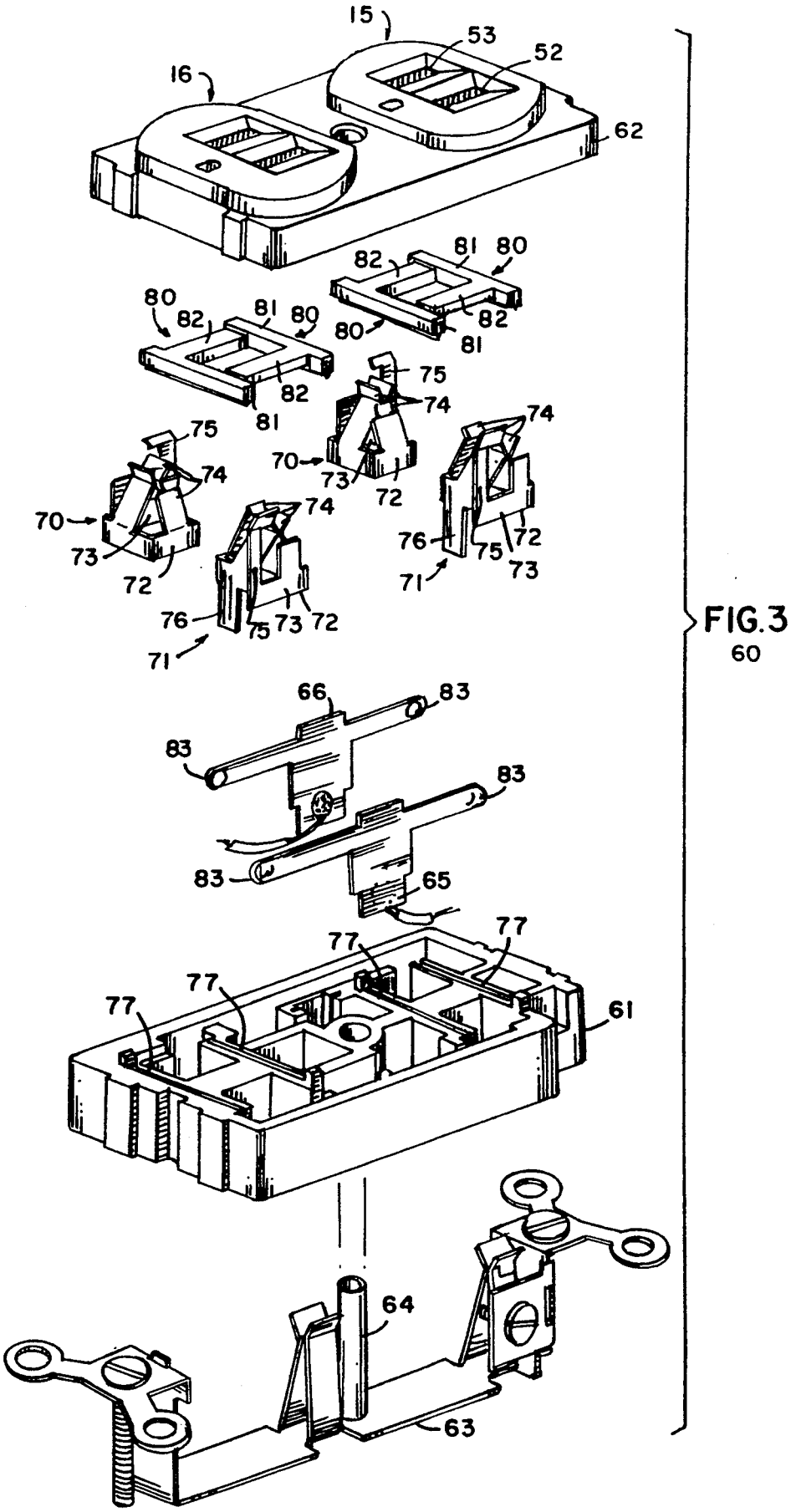
FIG. 3 is an exploded perspective view of another embodiment of an electrical receptacle adapted to be utilized in this invention.

FIG. 3 discloses another embodiment of a standard duplex outlet 60 that is modified for use with this invention. It is assumed that the duplex receptacle 60 corresponds to the duplex outlet that provides receptacle positions 15 and 16. The outlet 60 comprises an insulating base 61 and an insulating cover 62. A ground strap 63 with a rivet 64 clamps the various parts of the outlet 60 in an assembly. A neutral wiring terminal 65 and a power wiring terminal 66 lie in cavities adjacent opposite sides of the housing 61.

Power contact structures 70 and neutral contact structures 71 lie in internal cavities adjacent the power and neutral wiring terminals 66 and 65. Each contact structure generally has a square base 72 with one elongated side 73 that generally extends beyond the square. Three upstanding legs 74 with flared upper portions form a universal female contact that accepts different plug contact configurations. The cover 62 with its straight slots, such as slots 52 and 53, defines which of the pairs of female contacts 74 will engage the plug contacts. An extension 75 from the elongated side 73 on each of the power and neutral contact structures 70 and 71 extends toward the cover 62. In accordance with this invention the neutral contact structures 71 have extensions 76 that exit the housing 61.

Transverse slots 77 formed in the base 61 serve as tracks for L-shaped activators 80. Each activator has a leg 81 that rides on one of the tracks. An extension 82 at right angles to the leg 81 is offset from the end to align with one of the female contacts and to block access to the slots 52 and 53. A remote end of each leg 81 abuts one of the extensions 75 that normally is spaced from a contact 83 on a corresponding one of the neutral and power terminals 65 and 66.

When the male terminals of a plug enter through the slots 52 and 53, they engage corresponding extensions 82 and force them together so the end portions displace the extensions 75 into the respective contacts 83. When the plug is removed, the extensions 75 return to an unbiased condition and break the contacts between the terminals 65 and 66 and the corresponding contact structures 71 and 70.

Thus, FIGS. 2 and 3 disclose diverse embodiments of electrical outlets with receptacles modified in accordance with this invention. The base 31 and cover 32 in FIG. 2 and the base 61 and cover 62 in FIG. 3 support electrical plugs. Each receptacle contains neutral and power wiring terminal means in the form of the terminals 35 and 36 and 65 and 66. Each receptacle contains contact means for engaging the male contacts on a plug in the form of the female contact structures 41 and 44 in FIG. 2 and contact structures 74 in FIG. 3. Each receptacle contains an electrical switch in a form of the tabs 45 and 54 in FIG. 2 and the extensions 75 and contacts 83 in FIG. 3 that shift between a first, or closed state when a plug is inserted to a second, or open, position when the plug is removed. The activating disks 51 and the activators 80 in FIGS. 2 and 3 respectively constitute a switch actuating means that responds to the insertion of the plug contacts into the receptacle for closing the electrical switching means, The extensions 46 and 76 in FIGS. 2 and 3 constitute conductive means connected to the neutral switching means that extend through the receptacle means.

Figure 4:
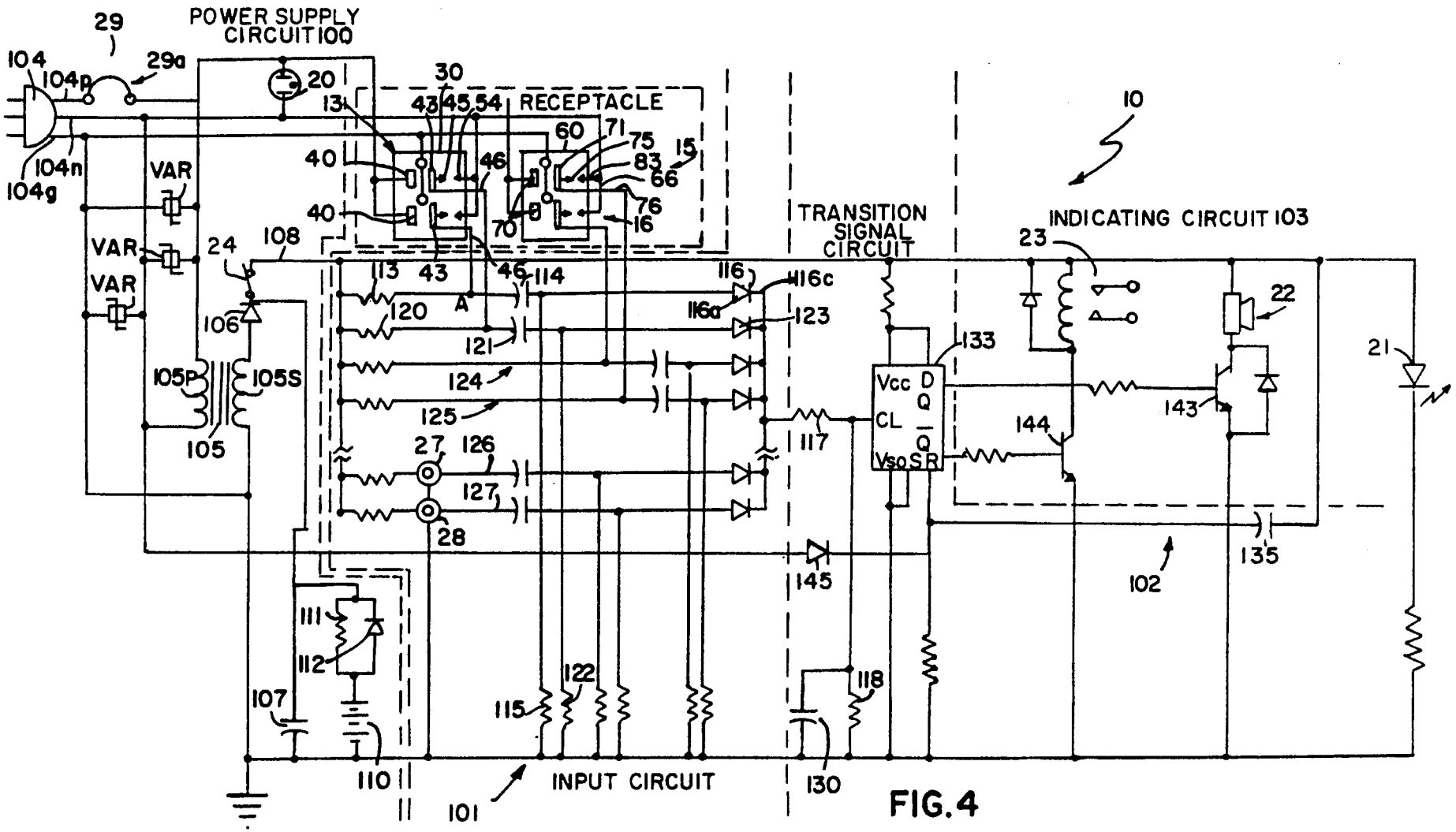
FIG. 4 is a schematic view of the apparatus circuitry utilized in accordance with this invention.

The schematic of FIG. 4 illustrates one embodiment of an alarm or annunciator circuit for installation in the housing 11 of FIG. 1 and for operation with receptacles such as shown in FIGS. 2 and 3 or any other electrical device that uses a switch to identify particular events. In general terms, the annunciator circuit of FIG. 4 includes a power supply circuit 100 that connects to an AC supply for producing various power supply voltages for the annunciator circuit. An input circuit 101 monitors the various switching contacts to produce first and second transition signals. In accordance with this embodiment, the input circuit 101 produces a first transition signal when a plug is removed from a receptacle and a second transition signal when the plug is inserted. A transition signal circuit 102 monitors the input circuit 101 and responds to a first transition signal by generating a transition sensed signal that activates the various annunciator elements in an indicator circuit 103.

The power supply circuit 100 includes a plug 104 that connects a power conductor **104*p*, a neutral conductor 104*n* and ground conductor 104*g* to an external AC power source. The AC power indicator 20 in FIG. 1 comprises a neon lamp 20 connected across the power and neutral conductors 104*p* and 104*n* on the load side of a circuit breaker 29*a* that includes the reset button 29 shown in FIG. 1**. Varistors (VAR) or other spike suppression elements connect between the various conductors.

The conductors **104*p* and 104*n* and 104*g* connect to the various receptacles in the outlets 30 and 60. FIG. 4 depicts schematically the receptacle 30 with its power contact structures 40 and neutral contact structures 43. Spaced arrows 45 and 54 represent the normally open switching position of tabs 45 and 54 and a conductor 46 represents the extension 46. Likewise FIG. 4 schematically depicts the receptacle 60 with its power and neutral contact structures 70 and 71, the extensions 75, the contacts 83 on the neutral wiring terminal 66 and the conductor 76 that represents the extension 76 from the neutral contact structure 71. So long as the plug 104 is plugged into a powered electrical outlet and the circuit breaker 29*a* is closed, the lamp 20 is on and the outlets 30 and 60 are energized when a plug is inserted into the outlets 30 and 60. The circuit breaker 29*a* provides overload protection for the appliances or other electrical devices that plug into the outlets 30 and 60**.

The power supply 100 also includes a transformer 105 with a primary 105P connected to the power and neutral conductors **104*p* and 104*n*. A secondary 105S connects to the ground conductor 104*g* and to a rectifier circuit comprising a diode 106 and a filter capacitor 107 that provides a filtered DC output voltage. The normally closed reset switch 24 couples this DC output voltage onto a DC bus 108**.

A rechargeable battery circuit including battery 110, a charge limiting resistor 111 and a blocking diode 112 enable the alarm functions in the circuit to operate even if the plug 104 temporarily disconnects from the remote power supply 100. While an AC voltage energizes the transformer primary 105P, the rectifier circuit provides a trickle charge to the battery 110 through the resistor 111. When the AC voltage is removed, the battery 110 discharges through the diode 112 to provide power to the remainder of the circuit.

The input circuit 101 has a number of analogous circuit legs for each of the receptacles 13 through 16. In a first leg a resistor 113 connects between the DC bus 108 at a junction A of the extensions 46 from the receptacle 14 and a capacitor 114. A resistor 115 connects to ground and to a junction formed by the other side of the capacitor 114 and the anode terminal of a diode 116. The capacitor 114 and resistor 115 constitute a high pass filter that produces first and second transition signals in response to each shift in state of the neutral terminal switching means constituted in the receptacle 30 by the tabs 45 and 54. When a plug is inserted in a receptacle 14, the tabs 45 and 54 are in contact, so the junction A is maintained at a ground potential. When the plug is removed, the tabs 45 and 54 separate, so the potential at junction A shifts to the voltage on the DC bus 108. The high-pass filter circuit comprising the capacitor 114 and 115 converts this transition into a positive going pulse at the anode terminal **116*a* of the diode 116. This pulse then passes through the diode 116 to the resistor 117 and a resistor 118 in the transition signal circuit 102**.

When a plug is inserted, the voltage at junction shifts to ground, and the filter circuit comprising the capacitor 114 and 115 converts this transition into a negative going pulse. However, the diode 116 blocks this pulse from reaching the resistor 117 and 118. Thus, the diode 116 is an example of a unidirectional conducting means in series between the high pass filter means and the transition signal circuit that couples only the first transition signals constituted by positive pulses to the transition signal circuit 102.

A second input leg of the input circuit 101 comprises a resistor 120 between the DC bus 108 and a capacitor 121, the junction of the resistor 120 and 121 being connected to the extension 46 from the receptacle 13. The capacitor 121 and another resistor 122, that connects to ground, form another high pass filter that connects to a diode 123. Similar input legs 124 and 125 connect to monitor the switching contacts in each of the receptacles 16 and 15 associated with the duplex outlet 60.

FIG. 4 additionally shows two analogous input legs 126 and 127 for monitoring the input jacks 27 and 28 of FIG. 1. If such jacks connect to remote switches with grounded contacts, the input resistors and high pass filters in each of legs 126 and 127 provide first and second transition signals that monitor those remote switching contacts.

All the diode cathodes, such as the cathode **116*c*, connect in common to provide a logical OR input to the transition circuit 102, particularly an input voltage divider comprising the resistor 117 and resistor 118. A capacitor 130 in parallel with the resistor 118 bypasses certain noise signals that may appear in the circuit to the ground conductor 104*g*** thereby minimizing false input signals and alarms in response to such noise signals.

Whenever a plug is removed, the leading edge of the resulting positive-going pulse through the resistors 117 and 118 in the transition signal circuit 102 produces an input signal for a bipolar latching means in the form of a D-type latch 133. The clocking (CL) input connects to the junction of the resistors 117 and 118; the data (D) input, to the DC bus 108 through a coupling resistor; and the overriding set (S) input to ground. As known, with the D input held at a high potential, a positive-going signal transition at the CL input sets the latch 133. When the latch 133 is set, the Q output is at a positive, or TRUE, level and the $\overline{Q}$ output is at a ground, or FALSE, level.

The transition signal circuit 102 additionally includes an initializing circuit in the form of a capacitor 135 between the DC power bus 108 and the overriding reset (R) input of the latch 133. When power is first applied to the power supply circuit 100, initial transients could cause a false clocking signal to be applied to the latch 133 without the capacitor 135. During this interval, however, the capacitor 135 maintains an active input at the overriding reset (R) input of the latch 133, so it can not set for an initial startup interval. These transients cease and stable operating conditions exist before the capacitor 135 charges the input signal to the overriding reset (R) input shifts to enable the latch 133 to respond to clocking inputs.

Any time a set of contacts being monitored by the input circuit 101 shifts from a closed to an open condition, the latch 133 sets and remains set until authorized personnel activate the reset switch 24. When this occurs, the normally closed contacts of the switch 24 open and interrupt the power on the DC bus 108 thereby to disable the alarm circuit. This condition remains until the reset key operated switch 24 returns to its operating condition (i.e., to close the contacts) whereupon power is again applied to the DC bus 108 to enable the alarm circuit latch 133 to respond to a clocking signal.

The specific indicating circuit 103 in FIG. 4 provides audible and electrical indications whenever an alarm condition exists. When a plug is removed and the latch 133 sets, a switching circuit, including a switching transistor 143, closes and establishes a return path for an audio generator, represented by the speaker 22, to produce an audible signal.

As shown in FIG. 4 normally opened contacts in the relay 23 provide an electrical annunciation. In this particular embodiment another switching circuit including a switching transistor 144 connects to the $\overline{Q}$ output of the latch 133 to energize the relay 23 and close the contacts during normal operations. When the latch 133 sets, the switching transistor 144 stops conducting, so the relay contacts open until the latch 133 resets. Thus continuity through the relay jack 23 in FIG. 1 indicates proper operation while a discontinuity indicates an abnormal condition.

In many applications external devices can produce significant noise signals on the power line between the neutral conductor **104*n* and the ground conductor 104*g*. The circuitry in FIG. 4 is immune to such noise signals. The input circuit 101 inherently blocks any noise signals that drive the neutral conductor 104*n* negative with respect to the ground conductor 104*g*. A diode 145 provides noise immunity with respect to any signals that drive the neutral conductor 104*n* positive with respect to the ground conductor 104*g*. Noise signals of positive polarity exist could filter through the receptacles 13 through 16 and the input circuit 101 and appear as positive-going transitions at the CL input of the latch 133 thereby generating false alarm annunciations. However, the diode 145, with its anode connected to the neutral conductor 104*n* and its cathode connected to the reset (R) input of the latch 133, couples such positive noise signals in parallel to the reset (R) input. Given the relative time delays through the input circuit 101, positive polarity noise signals produce an overriding resetting action at the latch 133 before the noise driven transition signals arrive at the CL input. Thus, the diode 145 provides immunity with respect to noise signals of a positive polarity by disabling the operation of the latch 133** for the duration of the noise signals.

Therefore in accordance with this invention annunciation apparatus, such as shown in FIG. 1 that includes receptacles modified as shown in FIGS. 2 and 3 and circuitry of the type shown in FIG. 4, overcomes the deficiencies of the prior art. The apparatus distinguishes between plug insertion and removal and produces an alarm only when a plug is removed. If a receptacle is empty or if a plug is inserted, there is no alarm. The circuitry used in the apparatus constructed in accordance with this invention is readily and reliably implemented by persons of ordinary skill in the art. Consequently, annunciation apparatus that embodies this invention is reliable, simple to operate and economical to produce.

This invention has been disclosed in terms of certain embodiments. It will be apparent that many modifications can be made to the disclosed apparatus without departing from the invention. For example, the specific apparatus shown in FIG. 1 contains two duplex outlets. This invention is also adapted for implementation with single receptacle outlets or multiple outlets and with or without remote switch input jacks. The circuitry of FIG. 4 can readily accommodate any reasonable number of switches by adding or deleting input legs in the input circuit 101. The apparatus is shown with specific embodiments of audible and electrical outputs. Other combinations can be included as can other specific alarms. Various modifications can be made to the annunciation circuit of FIG. 4. Different bipolar latching circuits can replace the D-type latch 133. Alternative output signal driver circuits can be added or substituted for the specifically disclosed switching transistor circuits. Different input circuit configurations are also possible. All of these modifications and variations may be made while still achieving some or all of the objectives of this invention. Therefore, it is the intent of the appended claims to cover all such variations and modifications as come within the true spirit and scope of this invention.

What is claimed as new and desired to be secured by letters patent of the United States is:

1. An electrical receptacle for use with an apparatus for detecting the removal from said receptacle of an electrical plug with a plurality of male contacts, said apparatus having first and second signalling inputs, said receptacle being adapted for connection to power and neutral conductors from a power source and comprising:

A. receptacle housing means for supporting the electrical plug, said receptacle housing means having an internal cavity and apertures defining passages from said internal cavity exteriorly of said receptacle housing means, B. a first contact engaging means for engaging one of the male contacts of the plug, and a second contact engaging means for engaging another one of the male contacts of the plug, each of said contact engaging means being supported by said receptacle housing means in said internal cavity, C. power terminal wiring means for receiving the power conductor and neutral terminal wiring means for receiving the neutral conductor each of said terminal wiring means extending through said apertures and located partially in said internal cavity and partially exteriorly to said receptacle housing means and being adapted for connection to said first signalling input of the apparatus, D. power electrical switching means for connecting said power terminal wiring means to said first contact engaging means and neutral electrical switching means for connecting said neutral terminal wiring means to said second contact engaging means, each of said electrical switching means controlling the conductive state between said respective terminal wiring means and said contact engaging means and being positioned in said internal cavity, E. power switch actuating means and neutral switch actuating means, each being supported by said receptacle housing means in said internal cavity and responsive to the insertion of plug male contacts into said receptacle housing means for changing the conductive state of said power and neutral electrical switching means respectively, whereby the conductive state between said first and second contact engaging means and respective said terminal means depends on the presence or absence of the plug in said receptacle housing means.

F. conductive feedthrough means extending from said neutral switching means and through another of said apertures in said housing means thereby to provide an electrical connection exteriorly of said receptacle housing means to said second signalling input.

2. An electrical receptacle as recited in claim 1 wherein said receptacle is adapted for supporting a plurality of electrical plugs, said electrical receptacle including a neutral switching means for each electrical plug and plurality of said conductive feedthrough means, each of said conductive feedthrough means being connected to one of said neutral switching means for providing independent access to each of said neutral switching means.

* * * * *